US007311537B2

(12) United States Patent
Hsu

(10) Patent No.: US 7,311,537 B2
(45) Date of Patent: Dec. 25, 2007

(54) CARD CONNECTOR

(75) Inventor: Chang-Shin Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/500,195

(22) Filed: Aug. 7, 2006

(65) Prior Publication Data

US 2007/0032108 A1 Feb. 8, 2007

(30) Foreign Application Priority Data

Aug. 5, 2005 (CN) ..... 2005 2 0074310 U

(51) Int. Cl.
*H01R 29/00* (2006.01)

(52) U.S. Cl. ..... 439/188; 439/489; 439/152

(58) Field of Classification Search ..... 439/152, 439/159, 188, 489, 630
See application file for complete search history.

(56) References Cited

U.S. PATENT DOCUMENTS 4,900,272 A * 2/1990 Lange et al. ..... 439/630
5,334,034 A * 8/1994 Reichardt et al. ..... 439/188
5,369,259 A * 11/1994 Bleier et al. ..... 235/441
5,370,544 A * 12/1994 Reichardt et al. ..... 439/188
6,004,155 A * 12/1999 Wu ..... 439/489
6,296,500 B1 * 10/2001 Liao ..... 439/188
6,431,893 B1 8/2002 Chang et al.
6,488,528 B2 * 12/2002 Nishioka ..... 439/489
7,128,589 B1 * 10/2006 Hsu ..... 439/159
2007/0032108 A1 * 2/2007 Hsu ..... 439/159

* cited by examiner

*Primary Examiner*—James Harvey
(74) *Attorney, Agent, or Firm*—Wei Te Chung

(57) ABSTRACT

A card connector adapted for receiving a card, comprises an insulating housing defining a card receiving space for the card, a plurality of contacts, an ejector for ejecting the card and at least two switch contacts for detecting whether the card is inserted. The ejector comprises a slider defining an original position and a final position, a spring, a holding equipment and a metal plate retained to the slider and moving together with the slider. One of the switch contacts not electrically connecting with the other switch contacts when the slider is at the original position, and all of the switch electrically connecting with each other by simultaneity contacting with the metal plate when the slider is at the final position.

11 Claims, 7 Drawing Sheets

CARD CONNECTOR

BACKGROUND OF THE INVENTION

1. Field of the Invention

The present invention is generally related to a card connector, and especially to a card connector with a switch for detecting a position of an electronic card.

2. Description of Related Art

An electrical card connector commonly has a switch device for indicating whether an electrical card is inserted therein. The switch device usually employs a stationary terminal and a moveable terminal which is pre-designed to be open or closed relative to the stationary terminal. When an electrical card is inserted into the card connector, the moveable terminal will be forced by the electrical card to electrically engage with or disengage from the stationary terminal thereby indicating the presence of the electrical card. Pertinent prior art U.S. Pat. Nos. 4,900,272; 5,369,259; 5,370,544, 5,334,034 and 6,004,155 disclose some related designs.

However, such conventional switch devices have several disadvantages. Firstly, the moveable and stationary terminals of the conventional switch devices have different configurations suited to achieve their moveable or stationary functions, which inevitably results in a more complicated manufacturing process and hence higher cost. Secondly, high precision when positioning the moveable and stationary contacts to ensure that the moveable terminal properly contacts the stationary terminal, thus increasing cost of assembly. Thirdly, additional positioning structures are required to be formed on a housing of the card connector to help position the moveable and stationary terminals. In addition, different arrangements of the moveable and stationary terminals are necessary according to the normally open or normally closed configuration of the switch device, which also complicates manufacture and increases costs of the connector.

Hence, an improved card connector is highly desired to overcome the aforementioned disadvantages of the prior art.

SUMMARY OF THE INVENTION

Accordingly, an object of the present invention is to provide a card connector which has a switch for detecting a card reliably.

To achieve the above-mentioned object, a card connector adapted for receiving a card comprises an insulating housing defining a card receiving space and a card insertion/ejection direction; a plurality of contacts retained in the insulating housing, an ejector assembled to the insulating housing and at least two switch contacts. The ejector comprises a slider movable along the card insertion and ejection direction, a spring urging the slider toward the card ejection direction, a holding equipment and a metal plate retained to the slider and moving together with the slider. The slider defines a original position and a final position where the holding equipment locks the slider. The switch contacts are installed in the insulating housing for detecting whether the card is inserted, at least one of the switch contacts is not electrically connecting with the other switch contacts when the slider is at the original position; and all of the switch electrically connecting with each other by simultaneity contacting with the metal plate when the slider is at the final position.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
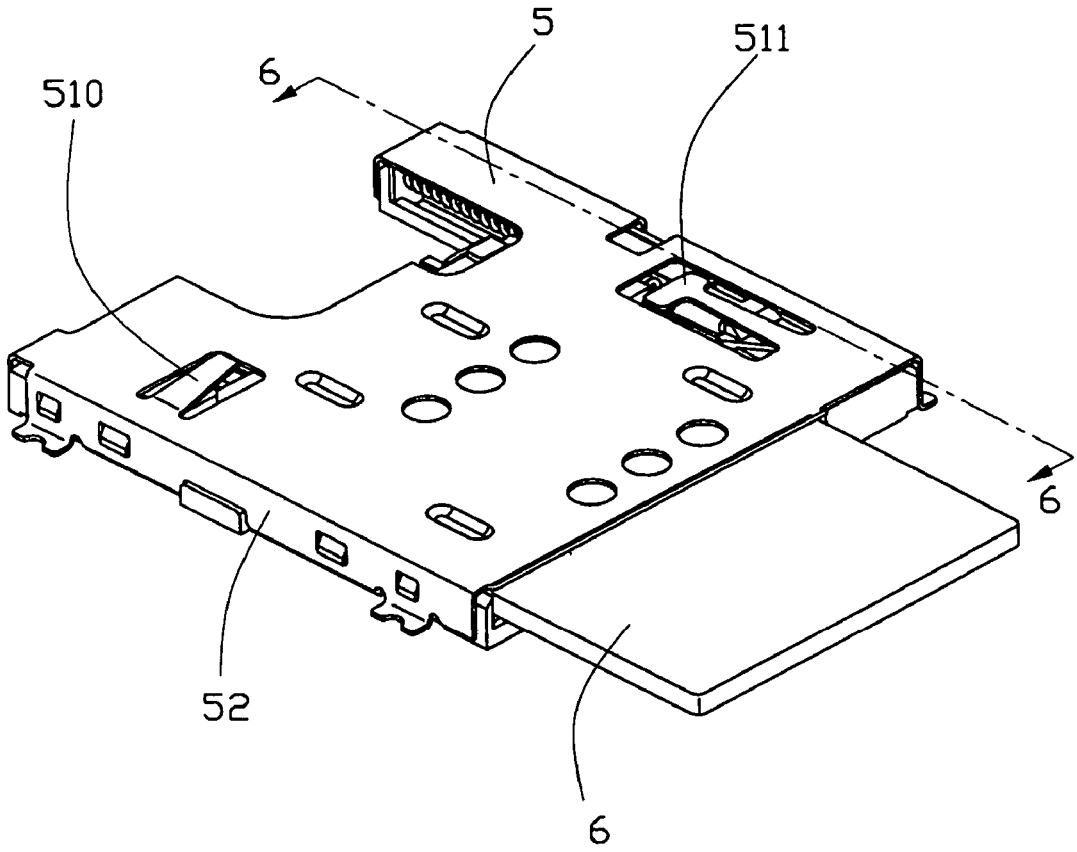
FIG. 1 is an assembled, perspective view of a card connector in accordance with the present invention with a card accommodated therein.
Figure 4:
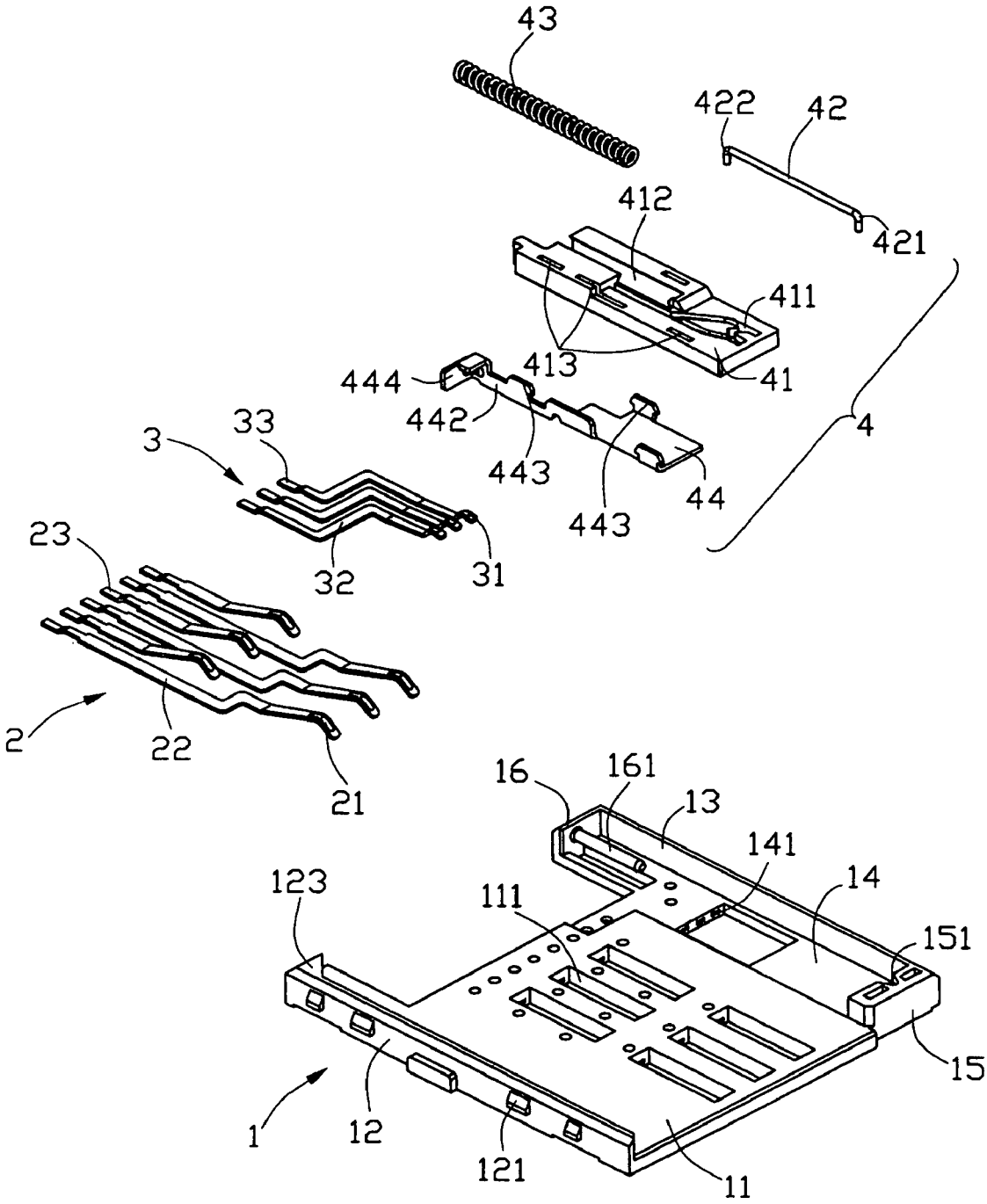
FIG. 4 is an exploded, perspective view of the card connector of FIG. 1.

Referring to FIG. 1 and FIG. 4, the card connector in accordance with the present invention is adapted for receiving a card 6, such as a SIM card. The card connector comprises an insulating housing 1, a plurality of contacts 2 received in the insulating housing 1, three switch contacts 3, an ejector 4 and a shell 5 covering the insulating housing 1.

Figure 2:
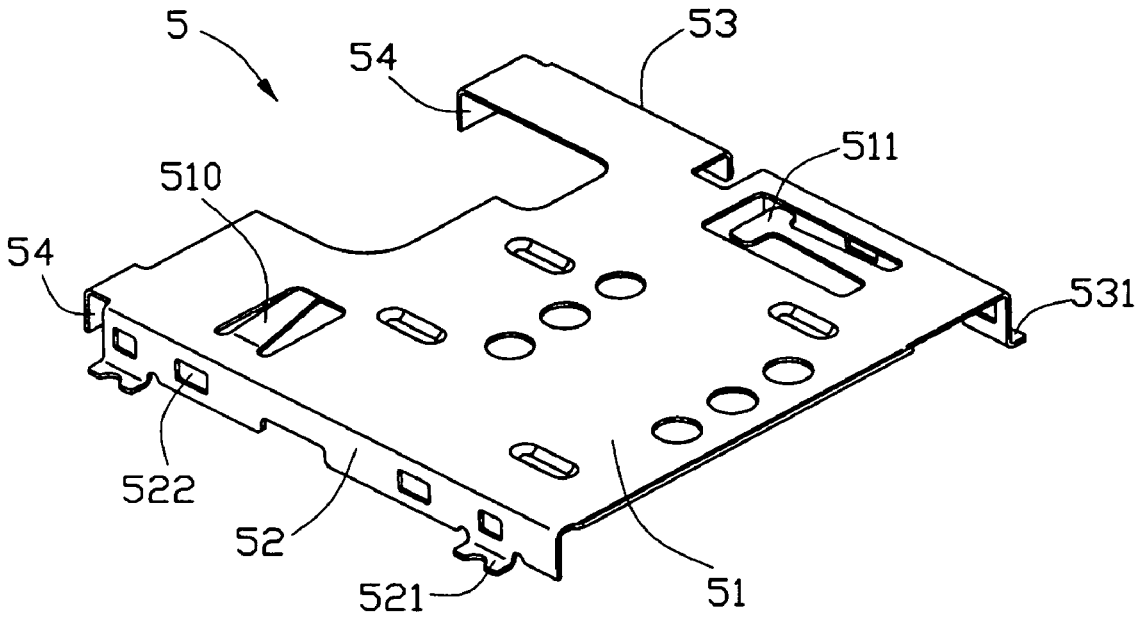
FIG. 2 is a partially exploded, perspective view of the card connector in accordance with the present invention, wherein a shell is detached from an insulating housing.
Figure 2:
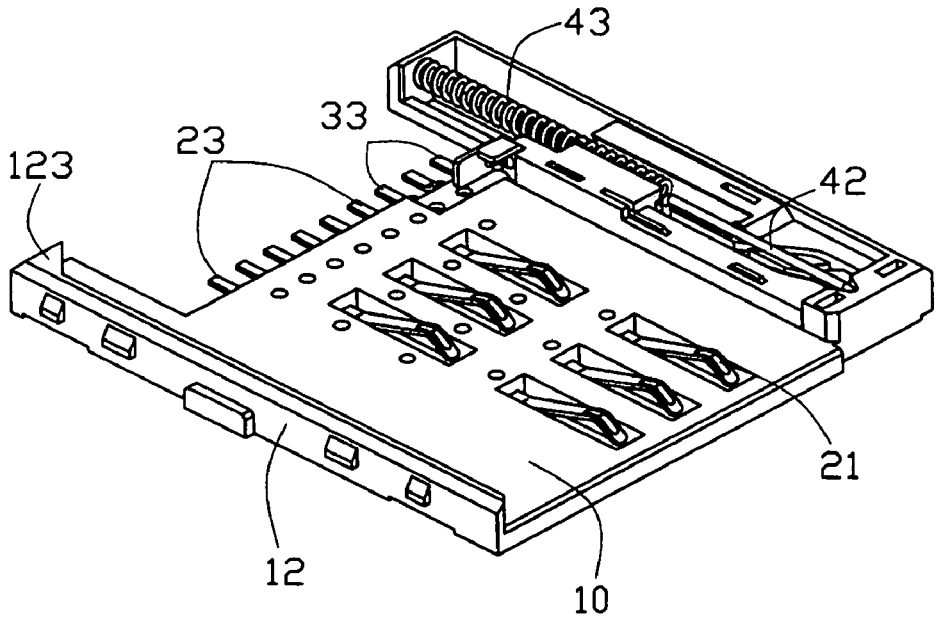

Referring to FIG. 2 and FIG. 4, the insulating housing 1 is approximately frame configuration. The insulating housing 1 comprises a bottom wall 11 and a pair of opposite left and right sidewalls 12, 13 extending upwardly from lateral sides of the bottom wall 11, all of which commonly define a card receiving space 10 for accommodating the SIM card 6 card and an insertion/ejection direction. The bottom wall 11 is formed with a plurality of rectangular receiving passages 111 arranged in two rows along the card insertion/ejection direction. The left and right sidewalls 12, 13 are formed with a plurality of wedges 121 on outside thereof for engaging with the shell 5. The bottom wall 11 defines a slot 14 extending along the right sidewall 13 for receiving a slider 41 of the ejector 4. The slot 14 communicates with the card receiving space 10 and defines a through hole 140 for positioning the switch contacts 3. The insulating housing 10 is formed with a pair of blocking walls 15, 16 being at a front and a rear ends of the slot 14, respectively, and linking with the right sidewall 13 thereof. A column 161 protrudes rearward from the blocking wall 16 and is exposed into the slot 14. A downwardly recessed hole 151 is formed on the blocking wall 15 in alignment with the column 161 along the card insertion/ejection direction.

Referring to FIGS. 2 and 4, the contacts 2 are divided into two groups which are retained in the insulating housing 1, respectively. Each contact 2 comprises a contacting portion 21 received in the corresponding receiving passage 111 and partially exposed into the card receiving space 10 for electrically contacting with the SIM card 6, an intermediate portion 22 extending forwardly from the contacting portion 21 and retained in the insulating housing 1, and a tail 23 soldered to a printed circuit board (not shown).

The switch contacts 3 are used for detecting the insertion of the IC card retained in the insulating housing 1 in a row vertical the card insertion/ejection direction. Each switch contact 3 has a contacting portion 31 received in the through hole 140 on the bottom wall 11, a linking portion 32 extending forwardly from the contacting portion 31, a retaining portion (not labeled) extending forwardly from the linking portion 32 and retained in the insulating housing 1 and a tail 33 soldered to the print circuit board (not shown). The contacting portions 31 of the switch contacts 3 are arranged in a row and partially exposed into the slot 14. The tails 33 of the switch contact 3 are aligned with the tails 23 of the contacts 2. The details description about the switch contacts 3 in working will be given thereinafter.

Figure 3:
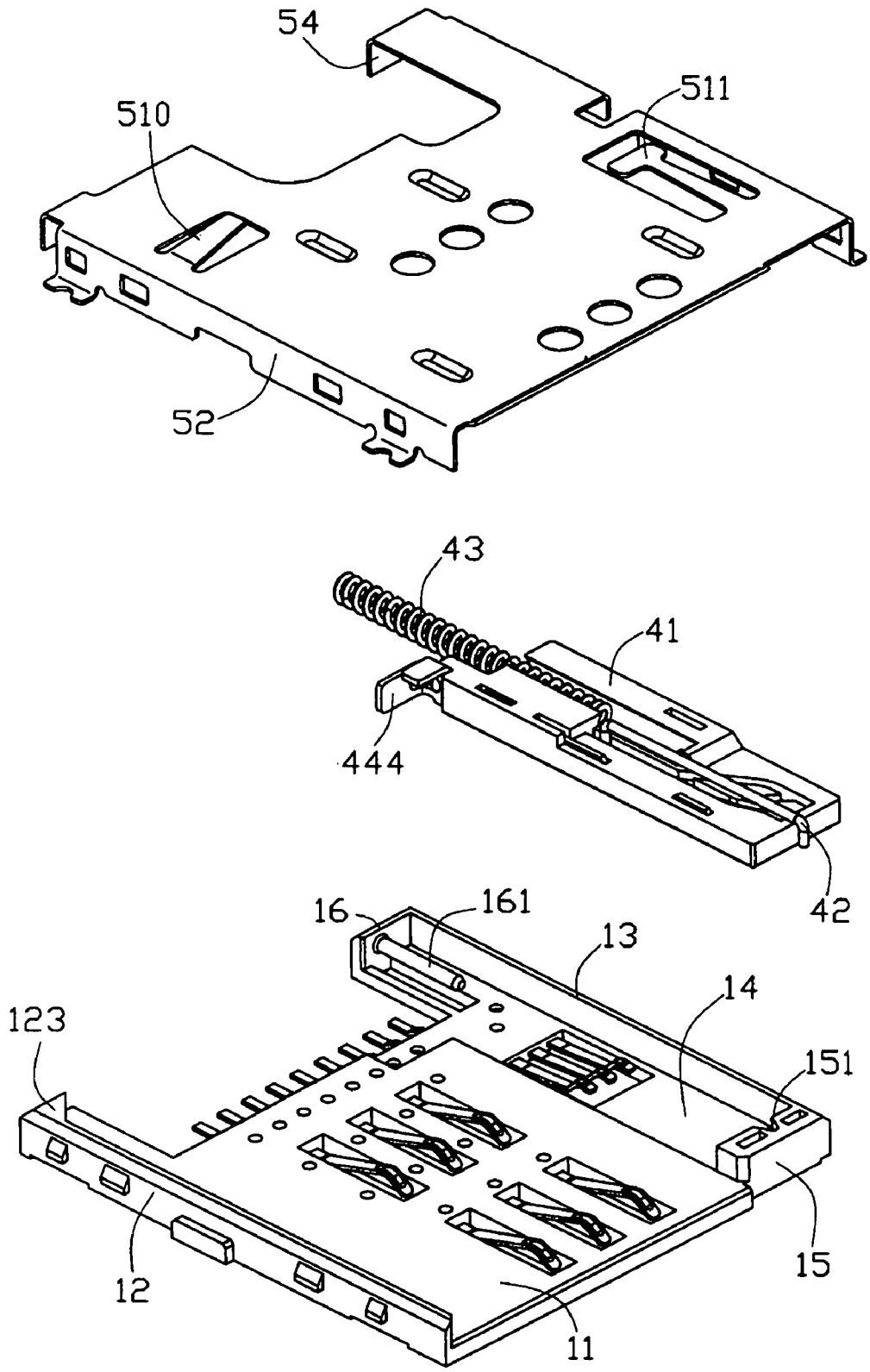
FIG. 3 is partially another exploded, perspective view of the card connector, wherein both of an ejector and a metal shell are detached from an insulating housing.
Figure 5:
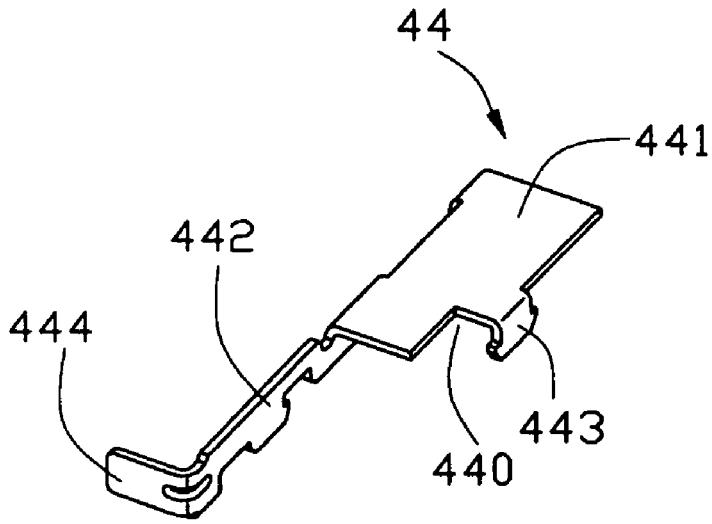
FIG. 5 is a perspective view of a slider and a metal plate of the ejector of the card connector.
Figure 5:
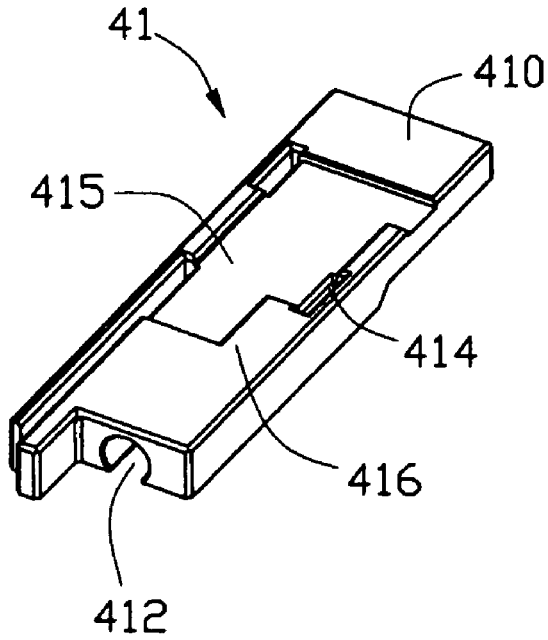

Referring to FIGS. 3-5, the ejector 4 comprises a slider 41 moveable along the card insertion/ejection direction, a pin member 42 with two bent ends, a spring 43 urging the slider 41 in the card ejection direction and a metal plate 44 assembled to the slider 41. The metal plate 44 is formed with an ejecting arm 444 protruding into the card receiving space 10 to directly eject the SIM card 6 on a front end thereof. However, the ejecting arm 444 also can be unitary with the slider 41 on condition that the ejecting arm 444 can protrude into the card receiving space 10.

The slider 41 is approximately an elongated cube configuration and is received in the slot 14 to move along the card insertion and ejection direction with the inserted SIM card 6. The slider 41 defines an original position and a final position where the SIM card electrically connects with the contacts, completely and fully. The slider 41 has a top surface (not labeled) and a bottom surface 410, and defines a heart-shaped groove 411 on a top face thereof, a semi-circular receiving hole 412 recessed rearward from a front face thereof, a plurality of through slots 413, 414 on lateral sides of the bottom face 410 thereof, an approximate L-shaped recess 415 on the bottom surface 410 thereof and an engaging portion 416 in the corner of the recess 415.

One end of the spring 43 is disposed around the column 161 of the blocking wall 16 and the other end is disposed into the receiving hole 412 of the slider 41. The pin member 42 has two bent ends 421, 422, the end 421 is securely locked in a hole 151 of the blocking wall 15 and the other end 422 is moveably disposed in the heart-shaped groove 411 of the slider 41 following a movement of the slider 41. The pin member 42 and the heart-shaped groove 411 are served as a holding equipment and can hold the slider 41 in the final position and can release the slider 41 when ejecting the SIM card 6.

Referring to FIGS. 4 and 5, the metal plate 44 is integrally stamped from a metal sheet. The metal plate 44 comprises a horizontal plate 441 received in the recess 415, an upright holding arm 442 extending upward and forwardly from a front end of inner side of the horizontal plate 441 adjacent to the card receiving space 10. A plurality of hooks 443 protrudes upwardly from the holding arm 442 and lateral sides of the horizontal plate 441, respectively. In addition, the holding arm 442 is formed with the ejecting arm 444 bent from a free end thereof and transversely protruding into the card receiving space 10. The metal plate 44 is securely assembled to a bottom face 410 of the slider 41 with the hooks 443 interferentially received in the through slots 413, 414 of the slider 41. The horizontal plate 441 defines a hatch 440 on a top right corner thereof for engaging with the engaging portion 416 of the slider 41.

Referring to FIG. 2 and FIG. 4, the shell 5 is stamped from a metal sheet to cover the insulating housing 1. The shell 5 comprises a top wall 51, a pair of opposite sidewalls 52, 53 extending downwardly from lateral sides of the top wall 51 and a front wall 54 extending from a front edge of the top wall 51. The top wall 51 is formed with a first resilient piece 511 for pressing downwardly against the pin member 42 towards the heart-shaped groove 411 of the slider 41 and a second resilient piece 510 extending upwardly therefrom. The sidewalls 52, 53 are formed with a plurality of gaps 522 for receiving the wedges 121 of the insulating housing 1 and two pairs of soldering feet 521, 531 on opposite distal ends along the card insertion and ejector direction for being mounted on the printed circuit board. The second resilient piece 510 is used for contacting with another electrical equipment surround the card connector and discharging the Electro-Static on the equipment.

In process of the SIM card 6 inserting the card connector, a front end of a right side of the card 6 will push the ejecting arm 444 and then drive the slider 41 to move along the card insertion direction and to urge the spring 43 to elastically distort. In the meantime, the pin member 42 moves along the heart-shaped groove 411 to make the slider 41 finally achieve the final position. When ejecting the card 6, a forward push force is exerted to the SIM card 6 to make the pin member 42 move along the heart-shaped groove 411 again so as to release the slider 41 from the final position. At this time, the resilient restorable force of the spring 43 urges the slider 41 to move along the card ejection direction so as to eject the SIM card 6 out of the card connector in virtue of the ejecting arm 444 of the ejector 4.

Figure 6:
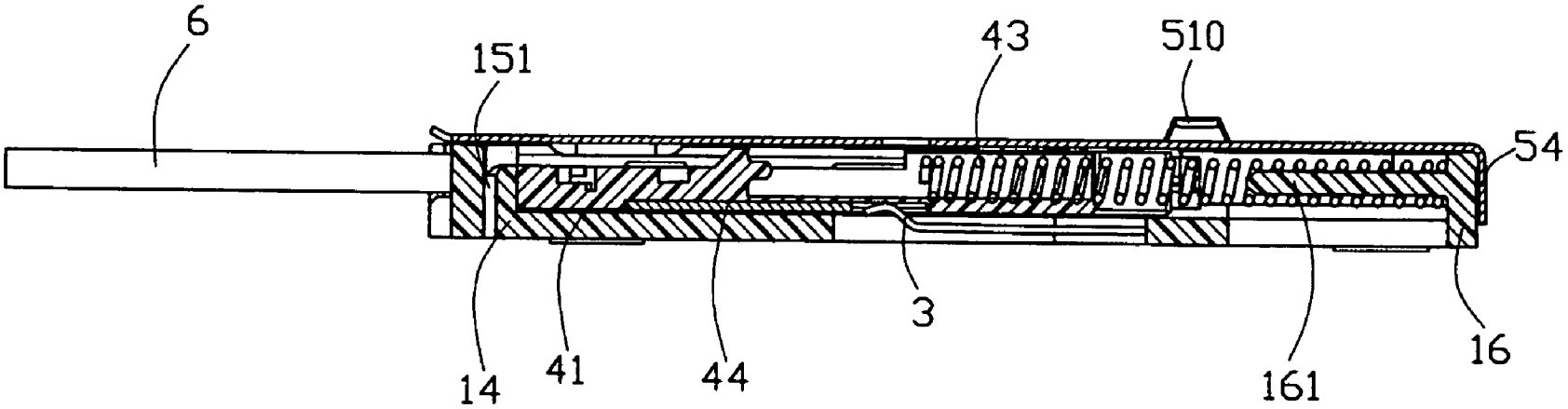
FIG. 6 is a cross-sectional view of FIG. 1 taken along line 6-6, wherein the slider is at an original position.
Figure 7:
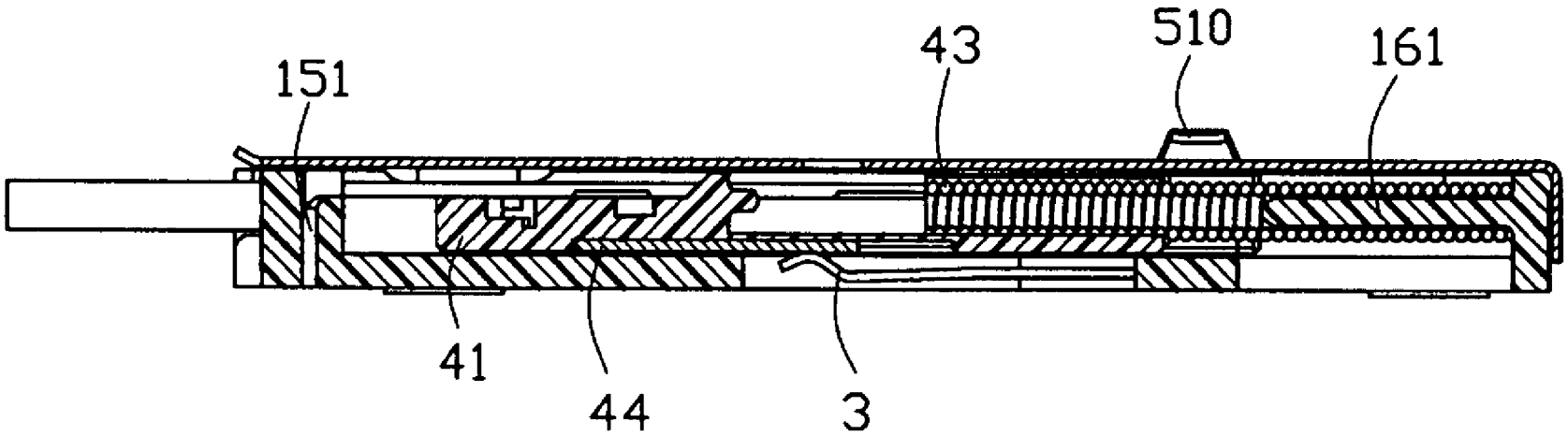
FIG. 7 is another cross-sectional view the card connector similar to FIG. 6, wherein the slider is at a final position.

Referring to FIGS. 1, 6 and 7, we will describe the working process about the switch contacts 3. After the ejector 4 is received in the slot 14 of the insulting housing 1, the switch contacts 3 is pre-loaded on grounds of the weight of the ejector 4. When the ejector 4 is positioned on the original position, the contacting portion 31 of at least one of the switch contacts 3 is corresponding to the hatch 440 of the metal plate 44 and pressed by the engaging portion 416 of the slider 4 as shown in FIG. 6, and the contacting portions 31 of the rest switch contacts 3 are pressed by the horizontal plate 441 of the metal plate 44. So at this original situation, not all of the switch contacts 3 electrically contact with the metal plate 44. When the slider 41 moves to the final position, all the switch contacts 3 will move rearward related to the slider 41 and the metal plate 44, and the switch contact 3 whose contacting portion originally abutting the engaging portion 416 of the slider 41 will slide away from the engaging portion 416 and abut the metal plate 44, as shown in FIG. 7, and the rest switch contacts 3 whose contacting portions originally abutting the metal plate 44 will slide on the metal plate 44 but still keep abutting with the metal plate 44. So at this final situation, all of the switch contacts 3 electrically contact with the metal plate 44, that means all of the switch contacts 3 electrically connect with each other, so a switch for detecting whether the SIM card 6 is inserted into the card connector is turned on. And when ejecting the SIM card 6, the slider 41 returns to the original position by force of the spring 43, the switch contacts 3 will come back to the original situation, wherein the contacting portion of one switch contact 3 will abut the slider 41 again. So the switch is turned off.

As a change embodiment, the number of the switch contacts 3 may reduce or increase, in condition that at least one switch contact is not abutting the metal plate 44 when the slider 41 is at the original position, including a case that all of the switch contacts do not abut the metal plate 44; and all of the switch contacts are contacting the metal plate 44 when the slider 41 is at the final position. Furthermore, the switch contacts 3 are able to wipe off the dust on the surface of the metal plate 44 during moving and ensure reliably electrically contacting between the switch contacts 3 and the metal plate 44.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector adapted for receiving a card, comprising:

an insulating housing defining a card receiving space for the card and a card insertion and ejection direction;

a plurality of contacts retained in the insulating housing;

an ejector assembled to the insulating housing and comprising a slider movable along the card insertion and ejection direction, a spring urging the slider toward the card ejection direction, a holding equipment and a metal plate retained to the slider and moving together with the slider, the slider defining a original position and a final position where the holding equipment locks the slider; and at least two switch contacts installed in the insulating housing for detecting whether the card is inserted, at least one of the switch contacts not electrically connecting with the other switch contacts when the slider is at the original position, and all of the switch contacts electrically connecting with each other by simultaneity contacting with the metal plate when the slider is at the final position.

2. The card connector as described in claim 1, wherein the switching contacts have contacting portions for contacting with the metal plate.

3. The card connector as described in claim 2, wherein the metal plate has a horizontal plate attached to a bottom surface of the slider, and the insulating housing defines a hole on a bottom wall thereof, the contacting portions of the switching contacts are received in the hole and extending upwardly to abut against the horizontal plate when the slider is at the final position.

4. The card connector as described in claim 3, wherein a number of the switching contacts is three, one of the switch contact is able to abut with the slider or the horizontal plate, selectively, according to a position of the slider, and the rest two switch contacts electrically abut the horizontal plate always.

5. The card connector as described in claim 4, wherein each of the contacts and the switch contacts has a tail, and all the tails are extending beyond the insulating housing and aligned in row.

6. The card connector as described in claim 4, wherein the switch contacts wipe off the dust on the surface of the horizontal plate during the slider moving.

7. The card connector as described in claim 1, further comprises a the shell coving the insulating housing, the shell has a top wall with a resilient piece extending upwardly for contacting with another electrical equipment surround the card connector and discharging the Electro-Static on the equipment.

8. The card connector as described in claim 1, wherein the metal plate is formed with an ejecting arm extending into the card receiving space for ejecting the card directly.

9. The card connector as described in claim 1, wherein the metal plate is formed with a plurality of hooks protruding from lateral sides thereof, the slider is formed with a plurality of slots recessed inward from at least one surface thereof, the metal plate is fixed to the slider with the hooks interferentially received in the slots.

10. A card connector for use with one card, comprising:

an insulative housing defining a card receiving space;

a plurality of contacts disposed in the housing;

an ejector assembled to the housing and moveable associatively with the card during insertion or ejection of the card, said ejector comprising:

slider moveable along a lengthwise direction of the housing in compliance with insertion or ejection directions of the card;

a metallic piece attached to the slider and associatively moveable with the slider; and a pair of switch contacts assembled to the housing and consistently structurally spaced from each other; wherein said pair of switches are electrically disconnected from each other when no card is received within the card receiving space while electrically connected to each other via said metallic piece when the card is received in the card receiving space.

11. The card connector as claimed in claim 10, wherein said metallic piece further includes an abutment tab laterally extending into the card receiving space and directly contacting a front edge of the card which is received in the card receiving space.

* * * * *